US005685935A

United States Patent [19]

Heyer et al.

[11] Patent Number: 5,685,935

[45] Date of Patent: Nov. 11, 1997

+

[54] METHOD OF PREPARING MELT BONDED NONWOVEN ARTICLES

[75] Inventors: Raymond F. Heyer, St. Paul; Connie L. Hubbard, Oakdale, both of Minn.

[73] Assignee: Minnesota Mining and Manufacturing Company, St. Paul, Minn.

[21] Appl. No.: 576,919

[22] Filed: Dec. 22, 1995

Related U.S. Application Data

[62] Division of Ser. No. 293,168, Aug. 19, 1994, abandoned, which is a continuation of Ser. No. 934,724, Aug. 24, 1992, abandoned.

[51] Int. Cl.[6] ..... B32B 29/02

[52] U.S. Cl. ..... 156/178; 51/295; 51/296; 51/298; 156/296; 156/308.4; 156/311; 156/322; 427/374.2; 427/379

[58] Field of Search ..... 51/295, 296, 297, 51/298; 156/178, 180, 296, 308.4, 311, 322; 427/209, 211, 374.2, 379

[56] References Cited

U.S. PATENT DOCUMENTS

| | | | |
|---|---|---|---|
| 2,451,915 | 10/1948 | Buresh . | |
| 2,700,188 | 1/1955 | Buresh et al. . | |
| 2,703,441 | 3/1955 | Langdon et al. . | |
| 2,744,294 | 5/1956 | Buresh et al. . | |
| 2,931,089 | 4/1960 | Evans . | |
| 2,958,593 | 11/1960 | Hoover et al. . | |
| 3,377,151 | 4/1968 | Lanham . | |
| 3,537,121 | 11/1970 | McAvoy . | |
| 3,595,738 | 7/1971 | Clarke et al. . | |
| 3,619,874 | 11/1971 | Li et al. . | |
| 3,781,172 | 12/1973 | Pett et al. . | |
| 3,788,999 | 1/1974 | Abler . | |
| 3,868,749 | 3/1975 | Cale . | |
| 3,891,408 | 6/1975 | Rowse et al. . | |
| 3,893,826 | 7/1975 | Quinan et al. . | |
| 4,040,139 | 8/1977 | Botvin | 15/209 |
| 4,078,340 | 3/1978 | Klecker et al. . | |
| 4,159,883 | 7/1979 | Mizell | 401/201 |
| 4,189,395 | 2/1980 | Limare et al. . | |
| 4,287,633 | 9/1981 | Gropper | 15/209 |
| 4,314,827 | 2/1982 | Leitheiser et al. . | |
| 4,505,720 | 3/1985 | Gabor et al. . | |
| 4,518,397 | 5/1985 | Leitheiser et al. . | |
| 4,574,003 | 3/1986 | Gerk . | |
| 4,744,802 | 5/1988 | Schwabel . | |
| 4,770,671 | 9/1988 | Monroe et al. . | |
| 4,856,134 | 8/1989 | Wertz et al. . | |
| 4,881,951 | 11/1989 | Wood et al. . | |
| 4,893,439 | 1/1990 | McAvoy . | |
| 4,991,362 | 2/1991 | Heyer et al. . | |
| 5,025,596 | 6/1991 | Heyer et al. . | |
| 5,030,496 | 7/1991 | McGurran . | |
| 5,082,720 | 1/1992 | Hayes . | |
| 5,152,809 | 10/1992 | Mattesky | 51/295 |

*Primary Examiner*—Marion E. McCamish
*Assistant Examiner*—Blaine R. Copenheaver
*Attorney, Agent, or Firm*—Gary L. Griswold; Walter N. Kirn; Doreen S. L. Gwin

[57] ABSTRACT

A nonwoven abrasive or scouring article having at least one major surface and an interior region comprises an open, lofty web of first and second crimped, staple organic thermoplastic fibers, wherein the first organic thermoplastic fiber comprises materials selected from the group consisting of polyamides, pololefins, and polyesters, and wherein said second organic thermoplastic fiber comprises at least two materials of different heat stability. The first and second organic crimped, staple thermoplastic fibers are melt-bonded together at least at a portion of points where they contact. At least a portion of the first and second fibers of one major surface of the nonwoven article have an abrasive coating bonded thereto, and at least a portion of the first and second fibers of the interior region have no abrasive coating bonded thereto, a structure which minimizes the amount of binder which must be used.

8 Claims, 1 Drawing Sheet

METHOD OF PREPARING MELT BONDED NONWOVEN ARTICLES

This is a division of application No. 08/293,168, filed Aug. 19, 1994, now abandoned, which is a continuation of application No. 07/934,724, filed Aug. 24, 1992, now abandoned.

BACKGROUND OF THE INVENTION

1. Field of the Invention

This invention relates to low-density nonwoven abrasive or scouring articles and methods of making same. More particularly, the articles comprise first and second staple fibers, the second fiber being bicomponent fiber, which allows the articles to be "rebulked".

2. Discussion of the Art

The use of lofty, fibrous, nonwoven abrasive products for scouring surfaces such as the soiled surfaces of pots and pans is well known. These products are typically lofty, nonwoven, open mats formed of fibers which are bonded together at points where they intersect and contact each other.

Low-density abrasive products of this type can be formed of randomly disposed staple fibers which are bonded together at points of contact with a binder that may contain abrasive particles. The staple fibers typically have been crimped and are laid into webs by equipment such as a "Rando-Webber" web-forming machine (marketed by the Curlator Corporation, of Rochester, N.Y. and described in U.S. Pat. Nos. 2,541,915; 2,700,188; 2,703,441 and 2,744,294) to form a lofty open mat. One very successful commercial embodiment of such an abrasive product is that sold under the trade designation "Scotch-Brite" by Minnesota Mining and Manufacturing Company of St. Paul, Minn. Low-density abrasive products of this type can be prepared by the method disclosed by Hoover et al. in U.S. Pat. No. 2,958,593. Hoover et al. describe such nonwoven pads as comprising > many interlaced randomly disposed flexible durable tough organic fibers which exhibit substantial resiliency and strength upon prolonged subjection to water and oils. Fibers of the web are firmly bonded together at points where they intersect and contact one another by globules of an organic binder, thereby forming a three-dimensionally integrated structure. Distributed within the web and firmly adhered by binder globules at variously spaced points along the fibers are abrasive particles.

Hoover, et al., at column 2, lines 61–70, column 3, line 1.

McAvoy, U.S. Pat. No. 3,537,121; McAvoy, et al., U.S. Pat. No. 4,893,439, and McGurran U.S. Pat. No. 5,030,496 also describe fibrous nonwoven surface treating articles.

U.S. Pat. No. 5,082,720 (Hayes) describes melt-bondable bicomponent fibers for use in nonwoven webs. The bicomponent fibers described therein have as a first component a polymer capable of forming fibers and a second component comprising a compatible blend of polymers capable of adhering to the surface of the first component. The second component has a melting temperature at least 30° C. below the melting temperature of the first component, but at least 130° C.

U.S. Pat. Nos. 3,377,151 (Lanham) and 4,856,134 (Wertz et al.) disclose open, lofty webs useful as scouring articles which have heated-sealed edges. There is no disclosure in either reference of the use of melt-bondable fibers in such a device, nor the advantages of using such fibers.

U.S. Pat. No. 4,078,340 (Klecker et al.) disclose an abrasive pad useful in cleaning and scouring kitchen utensils, the pad comprising a lofty fibrous nonwoven structure of mixed denier nylon or polyester crimped filaments bonded at contacting points with thermosetting resin containing finely divided soft abrasive and coated on one of its surfaces with thermosetting resin containing finely divided hard abrasive.

Producers of scouring pads are invariably seeking ways to minimize cost in manufacturing the scouring and abrasive pads and/or tailor scouring pads for specific uses. To the inventors' knowledge there has not been commercialized or otherwise disclosed a nonwoven scouring article comprised of crimped, staple organic thermoplastic fibers, wherein at least a portion of the fibers are melt-bondable, and wherein only the outermost portions of the article have adhered thereto abrasive particles while an interior region of the article does not. The current invention is drawn to such an article and method of producing such an article.

SUMMARY OF THE INVENTION

The present invention provides a low-density, lofty, open, porous, nonwoven scouring article. Articles of the invention have at least one major surface and an interior (i.e., not exposed) region and comprise webs made of first and second crimped, staple, organic thermoplastic fibers.

The first crimped staple organic thermoplastic fiber comprises materials selected from the group consisting of polyamides, polyolefins, polyesters, and may comprise a mixture of such fibers.

The second crimped staple organic thermoplastic fiber comprises bicomponent fibers having at least two materials of different heat stability. The heat stability of the lower heat stable component of the second crimped, staple, organic thermoplastic fiber is less than the heat stability of the first fiber. For purposes of this invention the term "bicomponent" fibers is meant to describe the second crimped staple fibers useful in the invention, although it will be understood that the term encompasses fibers having more than two components of differing heat stability.

The first and second fibers are melt-bonded together at least at a portion of the points where they contact, the melt-bonding being provided, for example, by passing heated air or other gas through the web, or by passing the web through a set of opposing metal rollers separated by a distance less than the original thickness of the web, where one or both metal rollers are heated (calendering).

At least a portion of the first and second fibers of said one major surface of said nonwoven article have an abrasive coating bonded thereto, and at least a portion of the first and second fibers of the interior region have no abrasive coating bonded thereto.

The articles of the invention are made by randomly arranging a multiplicity of crimped, staple first and second thermoplastic organic fibers in an open, lofty web in known fashion. The open, lofty web is then subjected to conditions sufficient to melt the lower heat stable component of the second crimped staple fiber at least at a portion of the points where they contact the first crimped staple fiber to form a web precursor.

The melt-bonded web is then passed through one or more sets of opposing rollers while the web is still at a temperature sufficient to melt the lower heat stable component of the second fiber. (Alternatively, the web may be cooled after melt-bonding and then reheated to the desired temperature.) The rollers are spaced apart by a gap sufficient to form a densified melt-bonded open, lofty web having a fraction of the loft of the melt-bonded open, lofty web.

The next step of the process is applying (preferably by passing the web through a second set of opposing rollers) a binder precursor slurry to at least a portion of a major surface of the densified melt-bonded open, lofty web, but not to the interior region, to form a partially coated densified web. The binder precursor slurry preferably comprises abrasive particles and a binder precursor solution. The viscosity of the binder precursor slurry primarily determines the gap that is required between the second set of rollers. The gap distance and binder precursor slurry viscosity are selected so that the binder precursor slurry does not penetrate to the center of the web. In other words, the binder precursor slurry penetrates only fraction of the thickness of the densified web, preferably less about one third of the thickness.

The partially coated densified web is then subjected to conditions sufficient to cure the binder precursor solution to form a web which is partially coated with a binder precursor slurry which is partially or fully cured.

The final step of the method is wherein the melt-bonded, densified, binder precursor slurry partially coated and cured web is subjected to a temperature sufficient to form a "rebulked" open, lofty web. As used herein "rebulked" means that the web has regained some or all of its original bulkiness or "loft" (loft means the thickness of the web measured from the surface of the web which touches the surface to be abraded to the upper surface of the web). The density of rebulked webs is less than that of the calendered and coated webs. The curing step and rebulking step may be carried out substantially simultaneously.

The finished web may then be cut into individual scouring articles. Edges of the articles may be bonded, for example "heat-sealed" by ultrasonic welding. Heat-sealing entails fusing of the thermoplastic fibers together by applying heat thereto. Other methods of bonding, such as by application of an adhesive, are also contemplated as possible bonding means.

Preferred methods include those wherein prior to the calendering step the melt-bonded open, lofty web is heat-sealed about at least a portion of its periphery, and a method wherein subsequent to the calendering step but prior to the coating step, said densified melt-bonded open, lofty web is heat-sealed at about at least a portion of its periphery. Also preferred are those methods wherein the melt-bonded, densified, heat-sealed web is subjected to a temperature sufficient to form a rebulked open, lofty web prior to the coating step. Further, the step of subjecting the web precursor to conditions sufficient to cause melting of the lower melting component of the second crimped staple fiber may be carried out substantially simultaneously with the calendering step if so desired.

Non-heat sealed, non-binder precursor-coated but melt-bonded portions of the finished web are thus formed between the heat-sealed edges and coated regions. Thus, the scouring articles of the invention are distinct from those disclosed in Hoover et al., discussed above, in that the use of binder precursor solution or slurry is decreased while not sacrificing strength. The use of bicomponent fibers in the articles of the invention allows a reduction in the amount of solvent used since less binder precursor solution is used to form the partially coated webs. The bicomponent fibers give the interior region stability without being coated. Furthermore, when a pad having greater abrasiveness on one major surface is desired, abrasive particles of varying hardness may be adherently bonded to the crimped staple organic thermoplastic fibers of the article, preferably before the individual articles are separated from the finished melt-bonded web.

The heat-sealed areas (if provided) are of sufficient size to permit division thereof at least two bond area segments per bond area, with each bond area segment having the partially coated,. melt-bonded web in a unitary structure. Individual pads may be provided by dividing each of the first and second bond areas, respectively, into at least two bond area segments, each having the melt-bonded web bonded therein in a unitary structure, by cutting the melt-bonded web within the bond areas, as taught in U.S. Pat. No. 4,991,362.

Other advantages of the invention may be appreciated by reading the following description of the invention.

BRIEF DESCRIPTION OF THE DRAWING

The features of the present invention can best be understood by reference to the accompanying drawing, wherein.

DESCRIPTION OF PREFERRED EMBODIMENTS

Nonwoven Web Precursors

Figure 1:
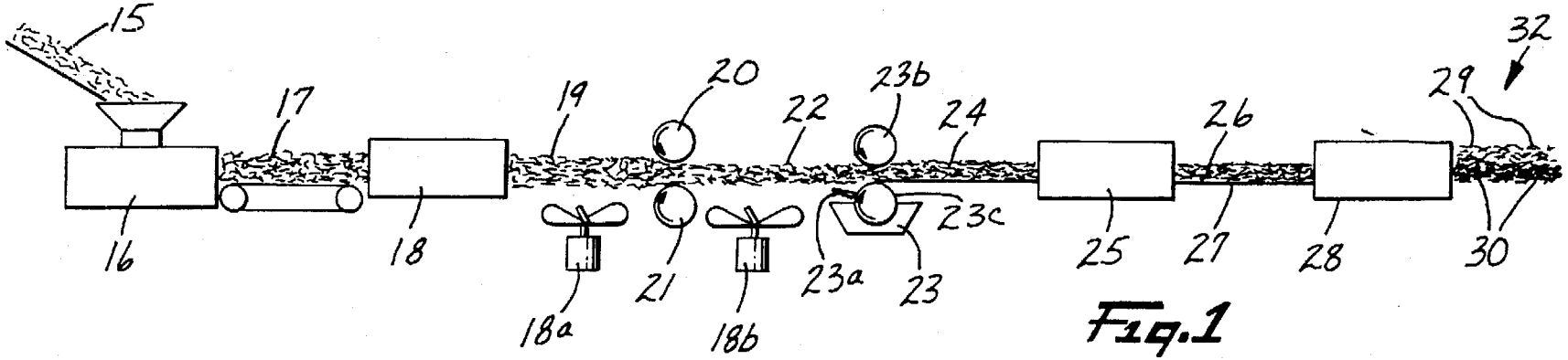
FIG. 1 is a schematic illustration of a process and apparatus useful in making the abrasive pads of the invention.

The open, lofty, nonwoven abrasive or scouring articles of the present invention are made from first fibers which are crimped, staple, thermoplastic organic fibers such as polyamide and polyester fibers. Crimped staple fibers can be processed and entangled into nonwoven webs by conventional web-forming machines such as that sold under the tradename "Rando-Webber" (commercially available from the Curlator Corporation). Methods useful for making nonwoven webs suitable for use in the invention from crimped, staple, synthetic fibers are disclosed by Hoover, et al., in U.S. Pat. No. 2,958,593 and also in U.S. Pat. No. 3,537,121, which are incorporated herein by reference.

The staple fibers may be stuffer-box crimped, gear crimped, helically crimped (as described, for example, in U.S. Pat. No. 4,893,439), or a combination of these or other fibers crimped by equivalent means. Suitable staple fibers known in the art are typically made of polyester or polyamide, although it is also known to use other fibers such as rayon and olefin fibers. Useful polyamides are polycaprolactam and polyhexamethyleneadipamide (e.g. nylon 6 and nylon 6,6), and the like; while useful polyolefins include polypropylene and polyethylene, and the like. Preferred first fibers of this invention are crimped polyester staple fibers, particularly crimped polyethylene terephthalate (PET) staple fibers.

Preferably, the thermoplastic materials used in the first and second fibers are sufficient to give the fibers a tenacity (break strength) of at least 1 gram per denier to provide the necessary degree of toughness for prolonged use as a scouring article.

An important aspect of the invention is that the nonwoven webs useful in making nonwoven abrasive or scouring articles of the invention contain up to about 50 weight percent bicomponent fibers, more preferably from about 20 to about 40 weight percent, to help stabilize the nonwoven web, facilitate the application of the coating resin, and, most importantly, provide a mechanism for rebulking the densified web upon the application of heat.

Bicomponent fibers useful in the present invention typically and preferably have a lower heat stable component made of polypropylene or other low-melting polymer such as a low heat stability polyester, as long as the temperature at which the lower heat stable component of the bicomponent fiber melts and adheres to the other fibers in the nonwoven web construction at a temperature lower than the melting or degradation temperature of the first fibers or second component of the bicomponent fibers. Suitable and preferable bicomponent fibers must be activatable at elevated temperatures below temperatures which would adversely affect the crimped first fibers. Additionally, the bicomponent fibers are preferably coprocessable with the first crimped fibers to form a lofty, open unbonded nonwoven web using conventional web forming equipment.

Typically and preferably, bicomponent fibers useful in the invention have a concentric core and a sheath, have been stuffer box crimped with about 6 to about 12 crimps per 25 mm, have a cut staple length of about 25 to about 100 mm, and have a tenacity of about 2–3 g/denier. Alternatively, bicomponent fibers may be of a side-by-side construction or have an eccentric core and sheath construction.

Bicomponent fibers as described in assignee's U.S. Pat. No. 5,082,720 (incorporated by reference herein) are preferred. This patent was discussed in the background of the invention. The first component of the bicomponent fibers is typically selected from polyesters, e.g. PET, polyphenylene sulfides, polyamides, e.g., nylon, polyimide, polyetherimide, and polyolefins, e.g. polypropylene.

Preferably the second component of the bicomponent fibers comprise a blend comprising at least one polymer that is at least partially crystalline and at least one amorphous polymer, where the blend has a melting temperature of at least 30° C. below the melting temperature of the first component. Additionally, the melting temperature of the second component is preferably at least 130° C. in order to avoid excessive softening resulting from the processing conditions to which the fibers will be exposed during the formation of nonwoven webs therefrom. These processing conditions typically involve temperatures in the area of 140° C. to 150° C. Fibers exhibiting these characteristics include polyesters, polyolefins, and polyamides. The ratio of crystalline to amorphous polymer has an effect both on the degree of shrinkage of nonwoven webs containing the melt-bondable fibers and the degree of bonding between first and second components of the melt-bondable fibers. The ratio of amorphous to partially crystalline polymer can range from about 15:85 to about 90:10.

As used herein the term "amorphous polymer" means a melt extrudable polymer that, during melting, does not exhibit a definite first order transition temperature, i.e., melting temperature. The polymers forming the second component must be compatible or capable of being rendered compatible. As used herein the term "compatible" refers to a blend wherein the components exist in a single phase. The second component must be capable of adhering to the first component. The blend of polymers comprising the second component preferably comprises crystalline and amorphous polymers of the same general polymeric type, such as, for example, polyester. Materials suitable for use as the second component include polyesters, polyolefins, and polyamides. Polyesters are preferred, because polyesters provide better adhesion than do other classes of polymeric materials.

The first and second components of the bicomponent fibers may be of different polymer types, such as, for example, polyester and polyamide, but they preferably are of the same polymer types. Use of polymers of the same type for both the first and second component produces bicomponent fibers that are more resistant to separation of the components during fiber spinning, stretching, crimping, and formation into nonwoven webs.

U.S. Pat. No. 3,595,738, incorporated herein by reference, discloses methods for the manufacture of helically crimped bicomponent polyester fibers suitable for use in this invention. The fibers produced by the method of that patent have a reversing helical crimp. Fibers having a reversing helical crimp are preferred over fibers that are crimped in a coiled configuration like a coiled spring. However, both types of helically crimped fibers are suitable for this invention. U.S. Pat. Nos. 3,868,749, 3,619,874, and 2,931,089, all of which are incorporated herein by reference, disclose various methods of edge crimping synthetic organic fibers to produce helically crimped fibers.

Helically crimped fibers typically and preferably have from about 1 to about 15 full cycle crimps per 25 mm fiber length, while stuffer box crimped fibers have about 3 to about 15 full cycle crimps per 25 mm fiber length. As taught in the '439 patent, when helically crimped fibers are used in conjunction with stuffer box crimped fibers, preferably the helically crimped fibers have fewer crimps per specified length than the stuffer box fibers.

Crimp index, a measure of fiber elasticity, preferably ranges from about 35 to about 70 percent for helically crimped fibers, which is about the same as stuffer box crimped fibers. Crimp index can be determined by measuring the fiber length when fully extended ("extended length"), measuring the fiber length when the fiber is relaxed ("relaxed length"), then subtracting the relaxed length from the extended length, and then dividing the resulting value by the extended length and multiplying that value by 100. (The values of the appropriate load used to stretch the fiber depends on the fiber denier. For fibers of the invention having 50 100 denier, a load of about 0.1–0.2 gram may be used, while a load of about 5–10 grams is used for higher denier fibers.) The variation in crimp index with heating can also be determined by exposing the fibers to an elevated temperature, e.g., 135° C. to 175° C. for 5 to 15 minutes, computing the crimp index, and this value compared with the crimp index before heat exposure. Crimp index measured after the fiber is exposed for 5 to 15 minutes to an elevated temperature, e.g., 135° C. to 175° C., should not significantly change from that measured before the heat exposure.

The length of the fibers employed is dependent upon the limitations of the processing equipment upon which the nonwoven open web is formed. However, depending on types of equipment, fibers of different lengths, or combinations thereof, very likely can be utilized in forming the lofty open webs of the desired ultimate characteristics specified herein. Fiber lengths suitable for helically crimped fibers preferably range from about 60 mm to about 150 mm, whereas suitable fiber lengths for stuffer box fibers range from about 25 to about 70 mm.

The denier (weight in grams of a fiber 9000 meters in length) of the fibers used in the nonwoven articles of the present invention is critical. As is generally known in the nonwoven abrasives field, larger denier fibers are preferred for more abrasive articles, smaller denier fibers are preferred for less abrasive articles, and fiber size must be suitable for lofty, open, low density abrasive products. Although the denier of fibers typically used for nonwoven abrasive articles may range broadly from about 6 to about 400, fiber size for nonwoven articles of the invention ranges from about 6 denier to about 200 denier, more preferably from about 15 to about 70 denier. Finer deniers than about 15 result in increased frictional drag, while fiber deniers larger than about 200 reduce drag, but an applied force from the user may shear the web rather than oscillate the web as is desired.

The nonwoven abrasive or scouring articles of the invention preferably have a non-compressed thickness of at least about 0.5 cm, more preferably ranging from about 2 cm to about 4 cm. As mentioned above, the thickness is dependent upon the fiber denier chosen for the particular application. If the fiber denier is too fine, the nonwoven articles of the invention will be less lofty and open, and thus thinner, resulting in the article tending to be more easily loaded with detritus from the surface being scoured.

Binder Compositions

Binders suitable for use in the nonwoven surface treating articles of the invention may comprise any thermoplastic or thermoset resin suitable for manufacture of nonwoven articles, but it will be clear to those skilled in the art of such manufacture that the resin in its final, cured state must be compatible (or capable of being rendered compatible) with the fibers of choice.

The cured resin preferably adheres to all of the types of fibers in a particular nonwoven article of the invention, thus deterring (preferably preventing) the subsequently made nonwoven scouring article from becoming prematurely worn during use. In addition, cured resins suitable for use in the invention preferably adhere to the abrasive particles so as to prevent the particles from prematurely loosening from the nonwoven scouring articles of the invention during use, but should allow the presentation of new abrasive particles to the surface being treated.

Another consideration is that the cured resin should be soft enough to allow the nonwoven scouring articles of the invention to be somewhat flexible during use as a scouring pad so as to allow the pad to conform to irregularities in the article being scoured. However, the cured resin preferably should not be so soft as to cause undue frictional drag between the nonwoven scouring articles of the invention and the surface being scoured.

Suitable resins will not readily undergo unwanted reactions, will be stable over a wide pH (negative logarithm of hydrogen ion concentration) and humidity ranges, and will resist moderate oxidation and reduction. The cured resins should be stable at higher temperatures and have a relatively long shelf life.

The resins of the binders suitable for use in the nonwoven surface treating articles of the invention may comprise any of a wide variety of resins, including synthetic polymers such as styrene-butadiene (SBR) copolymers, carboxylated-SBR copolymers, melamine resins, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof.

One preferred group of resins useful in the present invention are phenol-aldehyde resins, which comprise the reaction product of a phenol derivative and an aldehyde. As used herein the term "phenol derivative" is meant to include phenol, alkyl-substituted phenols, including cresols, xylenols, p-tert-butyl-phenol, p-phenylphenol, and nonylphenol. Diphenols, e.g., resorcinol (1,3-benzenediol) and bisphenol-A (bis-A or 2,2-bis(4-hydroxyphenyl) propane), are employed in smaller quantities for applications requiring special properties.

Aldehydes useful in forming phenol-aldehyde resins useful in the invention include cyclic, straight and branched chain alkyl aldehydes, and aromatic aldehydes. Preferably, the aldehydes have molecular weight less than about 300 to afford a less viscous binder precursor solution. Examples of suitable aldehydes include formaldehyde, benzaldehyde, propanal, hexanal, cyclohexane carboxaldehyde, acetaldehyde, butyraldehyde, valeraldehyde, and other low molecular weight aldehydes. Preferred is formaldehyde, for its availability, low cost, cured resin properties, and because it has low viscosity.

Particularly preferred phenol-aldehyde resins have the ingredients in the amounts listed in Table A.

TABLE A

Preferred Binder Precursor Slurries

| Ingredient | Broad wt % Range | Preferred wt % Range |
|---|---|---|
| A-stage base catalyzed phenol-formaldehyde resin (70% solids)[1] | 30–50 | 30–40 |
| deionized water | 5–15 | 8–12 |
| $Al_2O_3$ abrasive particles, 80 micrometers or less part. size[2] | 10–65 | 40–60 |
| catalyst (40% sol. of KOH | 0.1–0.5 | 0.1–0.3 |
| silicone antifoam agent[3] | 0.01–0.5 | 0.01–0.2 |
| isopropyl alcohol | 1–10 | 1–5 |
| suspending agent[4] | 0.1–1.0 | 0.1–0.5 |
| black pigment[5] | 0–1.0 | 0–0.5 |
| white pigment[6] | 2–10 | 2–5 |

[1]available from Reichhold Chemical as a 1.96:1 formaldehyde to phenol resin, with 2 wt % KOH as base catalyst
[2]available from 3M
[3]known under the trade designation "Q23168 Anti-Foam Emulsion", from Dow Corning Corp., Midland, MI
[4]known under the trade designation "CAB-O-SIL", from Cabot Corp., Tuscola, IL
[5]internally generated at 3M, including carbon black known under the trade designation "Monarch 120", from Cabot Corporation; phenol formaldehyde resin as mentioned above in this Table 1; and a mixture of propylene glycol monomethylether and ethylene glycol monomethylether
[6]known under the trade designation "Aqua-Sperse", number 877-0018, from Huls-America, Piscataway, NJ Nonwoven abrasive articles of the invention which comprise a substantial amount of polyamide (e.g., nylon 6,6) fibers preferably utilize as the resin component phenol-aldehyde resins, aminoplast resins, urethane resins, urea-aldehyde resins, isocyanurate resins, and mixtures thereof. One preferred resin is a thermally curable resole phenolic resin, and the resole phenolic resin of choice has about 1.7:1 formaldehyde to phenol weight ratio, 70 weight percent solids.

Examples of commercially available phenolic resins and which are useful in the present invention include those known by the trade names "Varcum" and "Durez" (from Occidental Chemicals Corp., N. Tonawanda, N.Y.), and "Arofene" (from Ashland Chemical Co.).

In one preferred method for making the nonwoven articles of the invention, a coatable binder precursor slurry, comprising uncured resin, abrasive particles, and other ingredients, such as thickeners, depending on the coating procedure, is applied to a nonwoven web using two-roll coating. Then, during further processing, the binder precursor is cured or polymerized to form a cured binder. Other coating methods may of course be employed as are known in the art, such as spray coating, and the like. The binder precursor slurry may be alternatively applied to the web without abrasive particles (i.e., in the form of a solution), with the abrasive particles electrostatically or mechanically deposited onto the web afterwards. However, it is preferred to mix the abrasive particles used in the invention with the binder precursor solution to prevent unnecessary dust hazards.

Binder precursor slurries or solutions and cured binders suitable for use in the invention may contain appropriate curing agents, non-abrasive fillers, pigments, and other materials which are desired to alter the final properties of the nonwoven scouring articles of the invention. Thus, the resins, binder precursor solutions, and binders useful in the invention are preferably compatible or capable of being rendered compatible with pigments.

Methods of Making the Articles of the Invention

FIG. 1 illustrates one process and apparatus for making the melt-bonded scouring articles of the invention. The open, lofty partially coated melt-bonded webs of the invention are made from open, lofty web precursors. Web precursors 17 may be formed from crimped staple fibers 15 at web forming station 16 by the methods described in Hoover et al. in U.S. Pat. No. 2,958,593 and by McAvoy in U.S. Pat. No. 3,537,121, previously incorporated herein by reference.

After forming the lofty, open web precursor 17, the web is melt-bonded by passing the web through a melt-bonding station 18, which may be a heated air space or equivalent heating means. Web 19 may optionally be cooled to room temperature or lower by cooling means, such as a forced draft fan 18*a*, so that the lower heat stable component of the bicomponent fibers solidify and bond to the first fibers in known fashion.

The melt-bonded web is then passed through the nip of opposing rollers 20 and 21 while web 19 is still at a temperature sufficient to melt the lower heat stable component of the bicomponent fiber. Passing the melt-bonded web through rollers 20 and 21 produces a densified, melt-bonded web 22, which has a density greater than melt-bonded web 19. The ratio of density of densified melt-bonded web 22 to melt-bonded web 19 may vary widely, but it is preferred that the ratio range from about 2:1 to about 8:1, more preferably from about 4:1 to about 8:1.

In the next step in preparing the open, lofty, nonwoven abrasive or scouring articles of the invention, densified melt-bonded web 22 is coated (on one or both sides) with a liquid binder precursor slurry, comprising binder precursor solution and abrasive particles, at station 23 to form a partially coated web 24. A doctor blade 23*a* is typically used to ensure that web 22 does not receive too much binder precursor slurry. The gap distance between rollers 23*b* and 23*c* preferably ranges from about 1.0 to about 3.0 mm; however, the gap distance is somewhat dependent on the viscosity of the binder precursor slurry subsequently applied. A narrow gap may be used if the viscosity of the binder precursor slurry is high, while a larger gap (or no rollers at all) could be used if the viscosity of the binder precursor slurry is low enough to prevent complete penetration of the binder precursor into the web. Binder precursor slurries presented in Table A above typically and preferably have a viscosity ranging from about 4000 to about 8000 cps (as measured using a Brookfield viscometer, #3 spindle, 12 rpm, at room temperature (about 20°–25° C.)).

The binder precursor solution on web 24 is subsequently cured at curing station 25 to form a partially coated, densified melt-bonded web 26. After this curing step, partially coated densified melt-bonded web 26 has a layer 27 of fibers and cured resin which is denser than the remainder of the web, due to the presence of the binder. It will be understood that web 26 may be turned over and also have binder precursor slurry coated on the opposite side. Finally, the partially coated and cured densified melt-bonded web 26 is passed through a rebulking station 28, which is preferably a heated air space, where the web is heated to remelt the lower melting component of the second fibers to effectuate the formation of a rebulked web 32. The exact temperature depends on the composition of the melt-bondable fibers and binder precursor slurry used. The temperature must be high enough to melt the lower heat stable component, but not high enough to decompose that component.

Rebulked web 32 has its lower portion of the fibers 30 coated with binder and abrasive particles, while upper portion 29 has no binder or abrasive particles. Portions 30 and 29 have relatively the same density, but web 32 has roughly 20% to about 90% of the density of web 19. The degree of rebulking may be altered by altering the time and/or temperature of the heated space 28, the composition of the fibers used, and the degree of crimp in the staple fibers.

Figure 3:
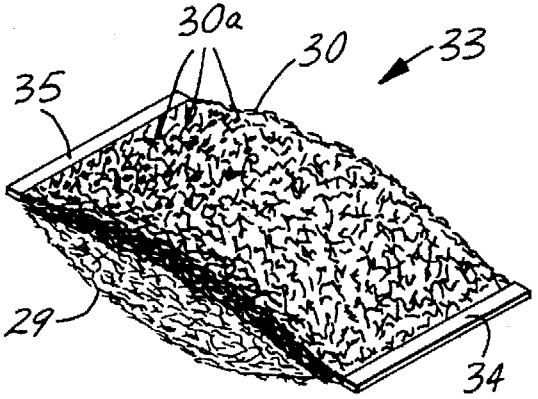
FIG. 3 is a perspective view of another individual pad made in accordance with the present invention which has two edges heat-sealed.
Figure 2:
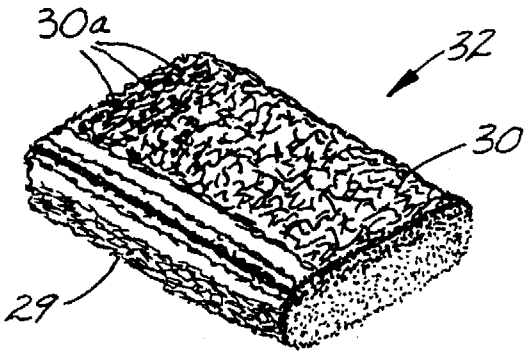
FIG. 2 is a perspective view of an individual pad made in accordance with the present invention which has no edge sealing.

FIG. 2 illustrates in perspective an individual scouring article 32 which is similar in all respects to rebulked web 32 of FIG. 1. FIG. 3 illustrates the article of FIG. 2 having two parallel heat-sealed edges 34 and 35, which may be formed by passing web 32 of FIG. 1 through a bonding station. The heat sealed edges may of course be of varying width, widths of 1 to 50 mm being typical and preferable. Smaller widths allow the final article to be wrung out without uncomfortable rough edges, while larger widths may be advantageous for particularly hard baked-on food residues or when a more sturdy article is preferred. The entire periphery or only a portion of the periphery of the articles of the invention may have heat-sealed edges. FIGS. 2 and 3 illustrate a non-coated interior region 29 and a coated region 30, where abrasive particles 30*a* are illustrated. Structures as illustrated in FIGS. 2 and 3 provide a unique combination of strength and scouring action while conserving binder precursor and abrasive particles.

The preferred method of bonding the webs on edge is by heat-sealing with an ultrasonic welder, such as a Branson "Sonic Sealer" available from Branson Sonic Power Company of Danbury, Conn. Other means for edge bonding may be used, such as a hot melt adhesive, or opposed heated plates.

The process as above described and illustrated in FIG. 1 may be modified as desired. Preferred modifications include a method wherein subsequent to the step where the web is cooled to form a melt-bonded web but prior to calendering, the melt-bonded open, lofty web is heat-sealed about at least a portion of its periphery. Also preferred is a method wherein subsequent to the calendaring step but prior to the coating step the densified heat-bonded open, lofty web is heat-sealed at about at least a portion of its periphery. Another preferred method is wherein the melt-bonded, densified, heat-sealed web is subjected to a temperature sufficient to form a rebulked open, lofty web subsequent prior to the coating step. A particularly preferred method is wherein the initial heating step and the calendering step are carried out substantially simultaneously. Another particularly preferred method is wherein the curing step 25 and rebulking step 28 are carried out substantially simultaneously.

As previously mentioned, examples of suitable thermosetting liquid adhesives include aqueous emulsions and solvent solutions of epoxy, melamine, phenolic, isocyanate and isocyanurate resins, and varnish. Conventional web coating techniques such as dip coating, roll coating, and spray coating may be used to coat the with the liquid adhesive binder. However, roll coating may be preferred in certain situations as it provides more control over loss of binder precursor to the environment as the binder precursor solution is being applied to the web than spray coating. The disadvantage of roll coating (increasing the density of the coated web when roll coating) is overcome and turned into an advantage by rebulking the melt-bonded web by heating the web to a temperature sufficient to melt the lower heat stable component of the bicomponent staple fiber, thus "releasing" those fibers from the first fibers. Preferably, about 90 percent of the original loft is regained, although less loft may be desirable for certain end uses of the articles. Depending on the degree and type of fiber crimp, it may be possible and desirable to achieve greater than 100% of the original loft, but the typical degree of loft ranges from about 50 to about 90%.

Another alternative to the process is that the densified web 22 of FIG. 1 may be coated with binder precursor solution and thereafter coated with abrasive particles, rather than slurry coating web 22. Conventional abrasive granule coating techniques, such as drop coating, electrostatic coating, and spray methods similar to those used in sand blasting, except with milder conditions, may be used to coat the wet abrasive coated filament array with abrasive particles. Roll coating is again preferred for the reasons discussed above. Thereafter, the binder precursor and abrasive particle coated densified melt-bonded web is typically passed through a forced air oven 25 to cure or set the binder resin and bond the abrasive particles to the fibers.

Abrasive particles are preferably adhered to the fibers of the nonwoven web by the resins of the binder precursor solutions described above. Abrasive particles useful in the nonwoven surface treating articles of the present invention may be individual abrasive particles, agglomerates of individual abrasive particles, or a mixture thereof.

The abrasive particles may be of any known abrasive material commonly used in the abrasives art. Preferably, the abrasive particles have a hardness of about 7 Mohs or greater. Examples of suitable abrasive particles include individual silicon carbide abrasive grains (including refractory coated silicon carbide abrasive grains such as disclosed in U.S. Pat. No. 4,505,720), fused aluminum oxide, heat treated fused aluminum oxide, alumina zirconia (including fused alumina zirconia such as disclosed in U.S. Pat. Nos. 3,781,172; 3,891,408; and 3,893,826, commercially available form the Norton Company of Worcester, Mass., under the trade designation "NorZon"), cubic boron nitride, garnet, pumice, sand, emery, mica, corundum, quartz, diamond, boron carbide, fused alumina, sintered alumina, alpha alumina-based ceramic material (available from Minnesota Mining and Manufacturing Company (3M), St. Paul, Minn., under the trade designation "Cubitron"), such as those disclosed in U.S. Pat. Nos. 4,314,827; 4,518,397; 4,574,003; 4,744,802; 4,770,671; and 4,881,951, and combinations thereof.

The abrasive particles are preferably present in a coatable binder precursor slurry (containing water and/or organic solvent, latex or other resin, abrasive particles, and other ingredients) at a weight percent (per total weight of coatable solution) ranging from about 10 to about 65 weight percent, more preferably from about 40 to about 60 weight percent.

The abrasive particles are not required to be uniformly dispersed on the fibers of the nonwoven articles having such particles, but a uniform dispersion within the portion of the article having coated fibers may provide more consistent abrasion characteristics.

The particle size of the abrasive particles can range from about 80 grade (average diameter of about 200 micrometers) to about 280 grade (average diameter of about 45 micrometers) or finer. However, when used in a kitchen scouring pad, the preferred average particle size of the abrasive particles should be on the order of about 45 micrometers or finer, to provide an aggressive abrasive surface capable of scouring pots and pans that are soiled with baked-on or burned cooking residues withput harmful scratching.

The articles of the invention may take any of a variety of shapes and sizes. For example, the article may be circular, elliptical, or quadrangular. However, the preferred article is rectangular and is of the size and bulk to be easily grasped in the hand of the user. Preferably, the pad is from about 5 to 15 cm in length, from about 5 to 10 cm in width, and from about 1 to 5 cm in thickness.

The most preferred embodiment of the present invention comprises a rectangular pad having length approximately 7 cm, a width of approximately 4 cm, and a thickness of approximately 3 cm, having 280 grade, or finer, aluminum oxide abrasive particles adhered to the crimped staple fibers by a phenolic resin binder. However, it is within the scope of the invention to include other ingredients in the pads such as pigments, filler, or other additives. It may be desired, for example, to impregnate the pad with a cleansing composition such as that disclosed in U.S. Pat. No. 3,788,999 or U.S. Pat. No. 4,189,395.

The invention is further illustrated by the following non-limiting examples wherein all parts and percentages are by weight unless otherwise specified.

EXAMPLES

Examples 1–10

Nonwoven, Melt-bonded Webs

Low density melt-bonded nonwoven webs were formed by a conventional web making machine (trade designation "Rando-Webber"). Each web formed was a blend of fibers comprising the fibers combination listed in Table 1. Where polyester staple fibers were used, they were 84 mm long helically crimped PET polyester staple fibers having crimp index of 49% except where otherwise indicated. The sheath-core bicomponent fibers used in all examples except Examples 7 and 10 were 58 mm long crimped sheath-core melt-bondable polyester staple fibers (core comprising polyethylene terephthalate, sheath comprising copolyester of ethylene terephthalate and isophthalate) having about 5 crimps per 25 mm and a sheath weight of about 50 percent, known under the trade designation "Alpha", from 3M. Examples 7 and 10 used similar fibers known under the trade designation "K54" from Hoescht-Celanese Company. The formed web in each case was heated in a hot convection oven for about three minutes at 160° C. and subsequently room temperature air cooled to bond the melt-bondable fibers together at points of intersection to form melt-bonded webs having a density of about 0.01 to about 0.02 gm/cc.

Examples 11–14 and Comparative Example A

Rebulked Webs

The melt-bonded webs of Examples 1, 5, 6, and 7 were densified by calendering, coated, and rebulked according to a process similar to that depicted in FIG. 1 to form the webs of Examples 11–14. Comparative Example A was a scouring article known by the trade designation "No Rust Wool Soap Pad", available from 3M, and described in U.S. Pat. Nos. 4,991,362 and 5,025,596. The melt-bonded calendered webs in each case had a density 4–8 times that of the melt-bonded web.

Each of the melt-bonded and calendered webs were then coated on one major surface with the binder precursor slurry of Table 2 to a dry coating weight of approximately 3 grams of resin in abrasive per pad (each pad having a length of approximately 7 cm, a width of approximately 4 cm and a thickness of approximately 3 cm). The binder precursor slurry, having viscosity of about 5000 cps (Brookfield viscometer, #3 spindle, 12 rpm, room temperature) was applied to the densified melt-bonded webs by passing the webs between a pair of vertically opposed, rotating, 250 mm diameter rubber covered squeeze rollers, separated by a gap of about 1.6 mm. The rotating lower roll, which was immersed in the binder precursor slurry, carried the slurry to the web so as to coat the major surface of the web which was exposed to the wet roller. The wet web in each case was dried and the binder precursor slurry cured in a hot air oven at about 165°–170° C. for about five to ten minutes, which also caused the densified melt-bonded webs to regain some loft and decrease in density. The dry, partially coated rebulked webs weighed about 580 g/m$^2$. The density of the rebulked webs ranged from about 30 to about 51 kilograms/meter$^3$ (kg/m$^3$). The fraction of the thickness of the pads having binder and abrasive particles was about one third of the total thickness of the pad in each case.

The web weights, loft, and densities before and after calendering and rebulking are summarized in Table 3. A legend is given after Table 3 which defines the shorthand notation used in the table.

TABLE 1

| Example | Fiber Composition | weight of web (grams/m$^2$) |
|---|---|---|
| 1 | 40% 12.5 den nylon 6,6<br>20% 30 den nylon 6,6<br>40% 15 den bicomponent | 480 |
| 2 | 80% 50 den polyester<br>20% 25 den bicomponent | 459 |
| 3 | 50% 70 den nylon<br>20% 15 den nylon<br>30% 25 den bicomponent | 481 |
| 4 | 65% 50 den × 76 mm polyester<br>35% 25 den bicomponent | 282 |
| 5 | 50% 50 den × 76 mm polyester<br>50% 25 den bicomponent | 270 |
| 6 | 65% 32 den × 76 mm polyester<br>35% 15 den bicomponent | 262 |
| 7 | 65% 25 den × 76 mm polyester<br>35% 15 den bicomponent | 380 |
| 8 | 50% 50 den × 32 mm polyester<br>50% 25 den bicomponent | 355 |

TABLE 1-continued

| Example | Fiber Composition | weight of web (grams/m$^2$) |
|---|---|---|
| 9 | 60% 50 den × 32 mm polyester<br>40% 25 den bicomponent | 324 |
| 10 | 65% 50 den × 76 mm polyester<br>35% 15 den bicomponent | — |

TABLE 2

| Ingredients | Amount in weight percent |
|---|---|
| A-stage base catalyzed phenol-formaldehyde resin (70% solids)[1] | 36.81 |
| isopropyl alcohol | 2.47 |
| deionized water | 9.88 |
| aluminum oxide (grade 240 and finer abrasive particles)[2] | 46.50 |
| black pigment[3] | 0.25 |
| white pigment[4] | 3.50 |
| suspending agent[5] | 0.50 |
| anti-foaming agent[6] | 0.10 |

[1]available from Reichhold Chemical as a 1.96:1 formaldehyde to phenol resin, with 2 wt % KOH as base catalyst
[2]commercially available from 3M
[3]internally generated at 3M, including carbon black known under the trade designation "Monarch 120", from Cabot Corporation; phenol-formaldehyde resin as mentioned above in this Table 2; and a mixture of propylene glycol monomethylether and ethylene glycol monomethylether
[4]known under the trade designation "Aqua-Sperse", number 877-0018, from Huls-America, Piscataway, NJ
[5]known under the trade designation "CAB-O-SIL", from Cabot Corp., Tuscola, IL
[6]known under the trade designation "Q23168 Anti-Foam Emulsion", from Dow Corning Corp., Midland, MI

TABLE 3

Web Properties

| Property[1] | Ex. 11 | Ex. 12 | Ex. 13 | Ex. 14 | Ex. A[2] |
|---|---|---|---|---|---|
| MBWW (gm/m$^2$) | 480 | 270 | 262 | 380 | — |
| MBWIL (cm) | 2.16 | 2.23 | 2.48 | 2.65 | — |
| MBWID (gm/cm$^3$) | 0.022 | 0.012 | 0.011 | 0.014 | — |
| CWL (cm) | 0.49 | 0.30 | 0.42 | 0.39 | — |
| CWD (gm/cm$^3$) | 0.099 | 0.089 | 0.062 | 0.095 | — |
| COATWT (gm/m$^2$) | 420 | 259 | 317 | 382 | 963 |
| RWL (cm) | 1.88 | 1.60 | 1.79 | 1.51 | — |
| % Rebulk | 87.4% | 71.7% | 72.4% | 56.9% | — |

[1]"MBWW": melt-bonded web weight;
"MBWIL": melt-bonded web initial loft;
"MBWID": melt-bonded web initial density;
"CWL": calendered web loft;
"CWD": calendered web density;
"COATWT": binder precursor coating weight
"RWL": rebulked web loft
[2]a commercially available pad from 3M made in accordance with U.S. Pat. Nos. 4,991,362 and 5,025,596, known under the trade designation "No Rust Wool Soap Pad"

Examples 11–14 and Comparative Example A

Food Scouring

The scouring pads formed in Examples 11–14 described above were then tested to determine their effectiveness in removing burned-on food from a stainless steel panel. A measured amount of a standard food soil composition was coated onto stainless steel panels and baked at 232° C. for 30 minutes. All the panels were alternately coated and baked 3 times in this manner.

The standard food soil had the following composition and was prepared as follows:

1. 120 grams "Campbell's" brand tomato juice;
2. 120 grams of "Oregon" brand canned cherry juice (without cherries);
3. 120 grams pure round beef (70% lean);
4. 60 grams "Kraft" brand shredded cheddar cheese;
5. 120 grams whole milk, homogenized;
6. 20 grams "Gold Medal" brand white all-purpose flour;
7. 100 grams "C&H" brand white granulated sugar;
8. 1 raw chicken egg, Grade AA Large (without shell).

The tomato juice and cherry juice were put into a blender known under the trade designation "Osterizer Liquefier Blender" and processed briefly on the "stir" setting. The beef was then added in small chunks, processed briefly between addition of chunks, as was the cheese. The milk was then added to the blender and the mixture processed on the "stir" setting for 7 minutes. The sugar and flour were then mixed in a separate cup and added to the blender in three portions (processing between additions), after which the mixture was processed on the "mix" setting for 7 minutes. The internal contents of the egg were placed into a paper cup and the shell discarded. The egg contents were stirred to break up the egg yolk and then added to the blender. The blender was turned to "Liquify" and held at that setting for 15 minutes, stopping every 3–4 minutes to let the blender cool for 1–2 minutes. The mixture was then stored in glass jars and refrigerated until used.

5.1 cm by 22.9 cm stainless steel panels were coated using the mixture as follows. An oven was preheated to 232° C. Meanwhile, 2 grams of food soil composition was placed near one end of the stainless steel panel to be coated and the panel placed on a flat surface. A coating rod known under the trade designation "RDS #60" was placed in contact with the food soil and the coating rod pulled (not rolled) across the entire length of the panel after which the rod was traversed in the opposite direction to the starting point. For each panel coated this step was repeated, for a total of three coating passes.

Coated panels were then placed on a metal cookie sheet and the sheet placed in the preheated oven for 30 minutes at 232° C. After 30 minutes the panels were removed from the oven and allowed to cool to room temperature.

Second and third food soil coatings were formed on the panels over the first coating exactly as described for the first coating (i.e, coating, baking, cooling for the second coating and similarly for the third coating). The coated panels were then allowed to cool to room temperature for 24 hours.

A coated panel was then placed into a slotted tray in a tank of water and a scouring pad to be tested was secured in a standard weighted holder (total weight of holder 2.5 kg) in a Heavy Duty Gardner Wear Tester (commercially available from Gardner Laboratory, Inc. of Bethesda, Md.) so that 0.32 cm of the scouring article extended out of the holder, and the holder and article passed back and forth over the surface of the coated panel to complete one cycle. Once the scouring article was secured properly in the holder, the tank of water had a dishwashing detergent (commercially available from the Proctor and Gamble Company of Cincinnati, Ohio, known under the trade designation "Ivory") added thereto in an amount of 2 ml of detergent per 250 ml of water. The test was started immediately after addition of the soap to the water in each case, with the automatic counter set to zero.

The removal of food soil was carefully observed. At the initial visual observation of the removal of food soil, the machine was stopped and the panel immediately removed. A transparent scanning chart was then placed over the soiled panel, and the number of completely cleaned squares recorded. Also, the number of ¾ clean squares or greater were counted, as well as the number of ¼ clean or less squares. The number of half clean squares was then determined by the number of ¼ clean squares minus the number of ¾ clean squares. The number of cycles on the automatic counter were noted.

The partially cleaned panels were then placed back into the water bath tray and the machine immediately started, without resetting the automatic counter. The number of cycles needed to remove 90% of the food soil was determined and recorded. The results (average of three runs for each) of the food removal tests using scouring articles of Examples 11–14 and Comparative Example A are reproduced in Table 4.

TABLE 4

Food Scouring Results

| Example | Cycles to 90% Clean |
|---|---|
| 11 | 226 |
| 12 | 386 |
| 13 | 230 |
| 14 | 249 |
| Comp Ex A, 3M "No Rust Wool Soap Pads" | 294 |

A lower number of cycles represents a more efficient scouring pad. The data presented in Table 4 indicates that the scouring pads of Examples 11–14 were about as effective as the 3M Brand "No Rust Wool Soap Pad", considering the small number of pads tested. It is quite valid to say that an effective scouring product could be made in this matter.

What is claimed is:

1. A method of making a nonwoven abrasive or scouring article having at least one major surface and an interior region, said article comprising a web of first and second crimped, staple organic thermoplastic fibers, said first organic thermoplastic fiber comprising materials selected from the group consisting of polyamides, polyolefins, and polyesters, and said second organic thermoplastic fiber comprising at least two materials of different heat stability, said first and second filaments melt bonded together at least at a portion of points where they contact, and wherein at least a portion of the first and second fibers of said one major surface of said nonwoven article have an abrasive coating bonded thereto which comprises a binder and abrasive particles, and wherein at least a portion of the first and second fibers of the interior region have no abrasive coating bonded thereto, said method comprising the steps of:

(a) arranging a multiplicity of said first and second crimped staple thermoplastic organic fibers into said open, lofty web;

(b) subjecting the open, lofty web to conditions sufficient to melt a lower heat stable component of the second crimped, staple thermoplastic organic fiber at least at a portion of the points where said lower heat stable components contact the first crimped, staple organic thermoplastic fibers to form a web precursor;

(c) while still at the conditions of step (b), passing the melt-bonded open, lofty web through one or more sets of opposed rollers which are spaced apart by a distance sufficient to form a densified melt-bonded open, lofty web having a fraction of the loft of the melt-bonded open, lofty web and at least one major surface;

(d) applying a binder precursor slurry to at least a portion of at least one major surface of said densified open, lofty web, but not to the interior region, said binder precursor slurry comprising abrasive particles and a binder precursor solution;

(e) subjecting the web of step (d) to conditions sufficient to at least partially cure said binder precursor solution and form a partially coated and partially cured densified melt-bonded web; and (f) subjecting said partially coated and partially cured densified melt-bonded web to a temperature sufficient to rebulk the partially coated and partially cured densified melt-bonded web.

2. A method in accordance with claim 1 wherein subsequent to step (c) but prior to step (d) the melt-bonded open, lofty web is heat-sealed about at least a portion of its periphery.

3. Method in accordance with claim 1 wherein subsequent to step (c) but before step (d), said densified melt-bonded open, lofty web is heat-sealed at about at least a portion of its periphery.

4. A method in accordance with claim 3 wherein said melt-bonded, densified, heat-sealed web is subjected to a temperature sufficient to form a rebulked open, lofty web subsequent prior to step (d).

5. A method in accordance with claim 1 wherein steps (b) and (c) are carried out substantially simultaneously.

6. A method in accordance with claim 1 wherein steps (e) and (f) are carried out substantially simultaneously.

7. A method in accordance with claim 1 wherein all of said first and second fibers of said interior region have no abrasive coating bonded thereto.

8. A method in accordance with claim 1 wherein subsequent to step (b) but before step (c) the melt-bonded open, lofty web is cooled and is then reheated.

* * * * *